US008453976B2

(12) United States Patent
Lauterberg

(10) Patent No.: US 8,453,976 B2
(45) Date of Patent: Jun. 4, 2013

(54) DETECTOR FOR COLD MOVEMENT DETECTION OF A RAILWAY VEHICLE, AND METHOD FOR ITS OPERATION

(75) Inventor: Veit Lauterberg, Neuhausen (DE)

(73) Assignee: Thales Deutschland GmbH, Stuttgart (DE)

( * ) Notice: Subject to any disclaimer, the term of this patent is extended or adjusted under 35 U.S.C. 154(b) by 0 days.

(21) Appl. No.: 13/409,461

(22) Filed: Mar. 1, 2012

(65) Prior Publication Data

US 2012/0241566 A1 Sep. 27, 2012

(30) Foreign Application Priority Data

Mar. 25, 2011 (EP) ..... 11159759

(51) Int. Cl.
*B61L 23/34* (2006.01)

(52) U.S. Cl.
USPC ..... 246/122 R; 246/167 R; 246/169 R

(58) Field of Classification Search
USPC ..... 246/122 R, 123, 124, 122 A, 167 R, 246/182 R
See application file for complete search history.

(56) References Cited

U.S. PATENT DOCUMENTS

| | | | | |
|---|---|---|---|---|
| 4,752,053 | A * | 6/1988 | Boetzkes | 246/167 R |
| 5,376,925 | A * | 12/1994 | Crisafulli et al. | 340/665 |
| 5,452,612 | A * | 9/1995 | Smith et al. | 73/514.34 |
| 5,507,457 | A * | 4/1996 | Kull | 246/169 R |
| 5,713,540 | A * | 2/1998 | Gerszberg et al. | 246/121 |
| 5,736,923 | A * | 4/1998 | Saab | 340/429 |
| 6,008,731 | A * | 12/1999 | Capan | 340/665 |
| 6,087,950 | A * | 7/2000 | Capan | 340/665 |
| 6,216,985 | B1 * | 4/2001 | Stephens | 246/120 |
| 7,467,342 | B2 * | 12/2008 | Ricchetti et al. | 714/733 |
| 8,015,874 | B2 * | 9/2011 | Uemura | 73/504.12 |
| 8,276,440 | B2 * | 10/2012 | Wach et al. | 73/117.01 |
| 2012/0217351 | A1 * | 8/2012 | Chadwick et al. | 246/169 R |
| 2012/0241566 | A1 * | 9/2012 | Lauterberg | 246/122 R |

* cited by examiner

*Primary Examiner* — Jason C Smith
(74) *Attorney, Agent, or Firm* — Hackler Daghighian & Martino

(57) ABSTRACT

An inventive detector detects movement of a railway vehicle in a powerless time interval. At its beginning, indicator items or first magnetic antagonists of detection cells are lifted by actuators to a switching device, which provides at least one holding section or second magnetic antagonist for a part of the indicator items which then stick to or near to the switching device by magnetic force. The switching device, though, is movably mounted and coupled to the railway vehicle's movement, so the holding section moves relative the detection cells if the railway vehicle moves. As a result, detection cells from which the holding section moves away experience a drop of the indicator item due to gravity. By means of sensors, such a drop is detected at the end of the time interval and used for cold movement indication.

19 Claims, 3 Drawing Sheets

DETECTOR FOR COLD MOVEMENT DETECTION OF A RAILWAY VEHICLE, AND METHOD FOR ITS OPERATION

The invention relates to a detector for cold movement detection of a railway vehicle comprising a) a switching device comprising at least one holding section and at least one non-holding section, wherein the switching device is moveable between at least two device positions by a mechanical coupling to the railway vehicle's movement.

Such a detector is known from "ETCS System Requirements Specification (SRS) Annexe A3 Proposed Technical Solutions", Version 03.01 (1996), chapter A3.1.1.1.

In a railway traffic network, the railway vehicles (such as trains or a single traction unit) operating in the network are typically registered in a central electronic system for coordinating the traffic, and the central electronic system gives (or denies) permissions to the registered railway vehicles to use specific track sections. For example, ETCS level 2 is such a central electronic system which works with radio-based permissions for the railway vehicles.

However, a railway vehicle is not operated all the time, but is parked at different occasions, for example overnight. When parking a railway vehicle, or when putting a railway vehicle into operation again, the railway vehicle is logged out of resp. logged into the central electronic system.

The central electronic system has to be highly reliable in coordinating the traffic, since errors may lead to collisions of trains, possibly hurting passengers or train drivers. Therefore, information about the railway vehicles operating in the network, in particular position information, must be highly reliable, too. As a result, logging in a railway vehicle is a complex and lengthy procedure, and typically requires passing a balise for safe position verification.

However, if a railway vehicle has not moved since its last logout, the login procedure may be simplified, since information about the railway vehicle already present in the central electronic system may be used again. For example, ETCS level 2 provides a simplified login procedure if movement since the last logout can be excluded.

In order to use this simplified login procedure, a highly reliable movement detection has to be provided. It should be noted that when a railway vehicle is parked, it is desired to switch off the power supply. Nevertheless the vehicle can be moved with a shunting operation or as wagon. Therefore, a movement detection not requiring power during the monitored parking time ("cold movement detection") is desired.

Movement detection can in principle be done by checking the railway vehicle's speed during the parking time. However, speed detection requires power and is therefore not suitable for cold movement detection.

A movement detection could also be done by a satellite based position finding, such as GPS, and comparing positions at the last logout and at the login request. However, inside of buildings or tunnels, satellites typically cannot be contacted. Further, an identical position at a last logout and a login request does not really exclude a movement in between.

The ETCS System Requirements Specification, see above, discloses a mechanical movement detector comprising an axle that rotates when a locomotive is moving. The axle has grooves suitable to hold a ball. The ball may be pushed into an upper groove by air pressure. When the axle rotates upon a movement of the locomotive, the upper groove becomes a lower groove, and the ball is dropped and may be detected by a photodiode.

It is the object of the invention to provide a simple and reliable movement detector which does not need power during a monitored time interval.

SUMMARY OF THE INVENTION

This object is achieved, in accordance with the invention, by a detector for cold movement detection of a railway vehicle, comprising a) a switching device comprising at least one holding section and at least one non-holding section, wherein the switching device is moveable between at least two device positions by a mechanical coupling to the railway vehicle's movement; and b) at least two detection cells, each comprising an indicator item, a guide along which the indicator item is movable between a top item position and a bottom item position, wherein the guide is oriented basically parallel to gravity, an actuator capable of moving the indicator item between the top and bottom item position, and a sensor for determining the position of the indicator item;

wherein the detection cells are positioned below the switching device such that in each device position of the at least two device positions of the switching device, at least one detection cell is close to a holding section, and at least one detection cell is close to a non-holding section, under the effect of gravity and without participation of the actuator, an indicator item in a top item position of a detection cell close to a holding section is close enough to the holding section so it is held by magnetic force in the top item position, and an indicator item in a top item position of a detection cell close to a non-holding section drops to the bottom item position, and upon moving to a next device position of the at least two device positions of the switching device, at least one detection cell changes from being close to a holding section to being close to a non-holding section.

The inventive detector exploits the range dependency of magnetic force. Within the detector, indicator items (which are permanently magnetic or ferromagnetic) may be lifted against gravity into an elevated position (top item position) by an actuator, where they may be held by magnetic force at a holding section (which is ferromagnetic or permanently magnetic) of a switching device.

When the vehicle moves, the switching device moves, too, and at the indicator item or its detection cell, respectively, the holding section is replaced at least temporarily by a non-holding section (which is typically non-magnetic, such as an empty space). This makes the indicator items fall ("drop") down (to the bottom item position), and the item cannot get back into the elevated position without the actuator again.

For determining whether the railway vehicle has moved during a specific time interval, one may compare the indicator item positions before and after the time interval. Any indicator item position change indicates a movement of the railway vehicle. Preferably, the number of top item positions and bottom item positions of indicator items after their lifting by the actuators, i.e. at the beginning of the time interval, is fixed by the design of the detector, and then only the indicator item positions after the time interval has ended must be determined in order to know about the railway vehicle's movement.

During the monitored time interval, no power is needed, since only gravity and permanent magnetic force act on the indicator items. Further, only few movable parts are needed for the inventive detector, so mechanical load and wear are low. The functionality is simple, and may be checked by simple means.

In case of external disturbances, the indicator items not already in a bottom item position will drop into the bottom item position (e.g. as a result of strong vibrations, maybe during an earthquake). Since this indicates a movement of the railway vehicle, these external disturbances put the detector into a "safe state", here meaning that the railway vehicle will have to undergo full (non-simplified) initialization procedures when logging into a central electronic system.

The guide is typically a cylindrical capsule of non-magnetic material in which the indicator item may move along the cylinder axis. The guide, or its guiding direction, respectively, is oriented basically parallel to gravity such that the indicator item may easily move under the force of gravity; typically the guide has an angle of 45° or less, preferably 30° or less, most preferably 15° or less with respect to the vertical direction.

In a preferred embodiment of the inventive detector, the at least one holding section is ferromagnetic, the at least one non-holding section is non-ferromagnetic, and the indicator item is a permanent magnet or at least comprises a permanent magnet. In this way, the permanent magnetic force can be used in the detector in a simple design; only few movement of permanent magnets (which may induce Eddy currents) is necessary then. In an alternative to the embodiment, the holding section may be permanently magnetic (or at least comprise a permanent magnet), the non-holding section may be non-magnetic, and the indicator item may be ferromagnetic.

Particularly preferred is an embodiment wherein the actuator is an electromagnetic coil. By means of the electromagnetic coil, when energized, a permanently magnetic indicator item may be affected and moved. Note that the magnetic axis of the indicator item is typically parallel to the guide's direction and the axis of the electromagnetic coil.

In an advantageous embodiment, the detector comprises at least three detection cells, in particular wherein in each device position of the at least two device positions, at least two detection cells are close to a holding section. Thus the detector may be equipped with redundancy. When at least two detection cells are close to a holding section initially, then even with one defective detection cell, a movement may be detected by a drop of the indicator item in the at least one other detection cell which was close to a holding section initially.

Particularly preferred is an embodiment wherein the detection cells are positioned below the switching device such that upon moving through all device positions of the at least two device positions, each detection cell is close to a non-holding section at least once. Thus all detection cells initially close to a holding section may take part in the movement detection, i.e. will exhibit a "drop" upon a move through all item positions.

Also preferred is an embodiment wherein the detection cells are positioned below the switching device such that upon moving to a next device position of the at least two device positions, at least one detection cell changes from being close to a non-holding section to being close to a holding section. This is a simple way to make sure that at any device position, at least one detection cell will be close to a holding section.

In a highly preferred embodiment, the switching device is mounted such that the movement of the switching device upon the railway vehicle's movement is cyclic. This ensures that during (sufficiently far) movement of the railway vehicle, all device positions will be gone through, and a maximum of detection cells may take part in movement detection. Further, with a cyclic movement of the switching device, no initialization of the switching device is necessary at the beginning of a time interval to be monitored. From any starting position, all other device positions may be gone through. Note that a cyclic movement of the switching device need not be a rotary motion, but may also be a back and forth movement of a slide, for example.

In an advantageous embodiment, the sensor is a Reed switch. From the different characteristics of the magnetic field around the detection cell in different item positions, the item position may be easily identified with the Reed switch. Most simply, the indicator item is a permanent magnet, and the Reed switch is positioned close to the bottom of the detection cell. In case the indicator item is ferromagnetic, its field forming capacity also generates locations where sharp field changes occur upon item movement, suitable for detection with a Reed switch.

Particularly preferred is an embodiment of an inventive detector wherein the switching device is designed as a toothed wheel. The toothed wheel is simple to couple to the railway vehicle's movement, e.g. by attaching it directly to a wheel axis of the railway vehicle, or by coupling it to such an axis with a gear drive. Typically, the teeth of the wheel act as holding sections, and the spaces between the teeth act as non-holding sections. The detection cells are typically arranged approximately along the circumference of the toothed wheel, typically near its bottom part. However, in case the teeth of the toothed wheel are stepped or inclined with respect to the axial direction of the toothed wheel, the detection cells may also be arranged along the axial direction.

In an alternative embodiment, the switching device is designed as a slide. This simplifies the arrangement of the detection cells. Note that the slide may be propelled by means of an eccentric attached to a wheel axis of the railway vehicle (or a coupled gear drive), thus allowing a cyclic movement of the slide.

Also within the scope of the present invention is a method for operating an inventive detector as described above, wherein the switching device is coupled to a railway vehicle's movement, and wherein the at least one non-holding section and the at least one holding section are distributed such that in each of the at least two device positions, exactly N detection cells of all A detection cells are close to a holding section, with the following steps:

i) the railway vehicle is stopped;

ii) all indicator items are moved into the top item position by the actuators, and the actuators are deactivated;

iii) wait for an arbitrary time interval;

iv) the positions of the indicator items are determined by the sensors, and the number B of indicator items in a bottom item position are counted;

v) if $B>(A-N)$ then a cold movement of the railway vehicle having taken place during step iii) is indicated.

Note that $A>N>0$ here. By this method cold movement detection may be realized in a particular simple way, in particular not requiring a storage for initial indicator item positions. A fixed number N of detection cells close to a holding section in any device position may be achieved in different ways, for example by constant area fractions of holding and non-holding sections above the entirety of all detection cells upon movement of the switching device between its device positions; for this purpose, a regular (preferably equidistant) arrangement of the detection cells, and a regular (preferably equidistant and/or periodic) arrangement of holding sections and non-holding sections in the switching device may be employed. Note that in designs wherein the number N of detection cells close to a holding section may vary depending on the device position, in an additional step iia), done between steps ii) and iii), the positions of the indicator items are determined by the sensors, and the number N of indicator items in a top item position are counted and stored for step v).

In a preferred variant of the inventive method, before step ii), a checking procedure is done comprising the following steps:

i') all indicator items are moved into the bottom item position by the actuators, ii') the positions of the indicator items are determined by the sensors, and the number B of indicator items in a bottom item position are counted;

iii') if B<A then a malfunction of the detector is indicated. By this procedure, indicator items stuck in a top item position, which may falsely indicate non-movement of the railway vehicle, may be identified. Note that steps i') through iii') may also be done independently of steps i) through v) when the train has stopped.

An advantageous variant provides that between steps ii) and iii), a checking procedure is done comprising the following steps:

i") the positions of the indicator items are determined by the sensors, and the number B of indicator items in a bottom item position are counted;

ii") if B>(A−N) then a malfunction of the detector is indicated. By this procedure, indicator items stuck in a bottom item position, which may falsely indicate a movement of the train, may be identified. Note that step ii") is only indicative if the railway vehicle remained at its position between lifting the indicator items in step ii) and the counting of B in step i"). Further note that steps i") through ii") may also be done independently of steps i) through v) when the train has stopped, the detector items have been lifted up and the actuators have been deactivated.

A further advantageous variant provides that before step i), a checking procedure is done comprising the following steps:

i'") all indicator items are moved into the top item position by the actuators, and the actuators are deactivated;

ii'") drive some distance with the railway vehicle such that all device positions of the at least two device positions have been gone through at least once;

iii'") the positions of the indicator items are determined by the sensors, and the number B of indicator items in a bottom item position are counted;

iv'") if B<A then a malfunction of the detector is indicated. By this procedure, indicator items stuck in a top item position, which may falsely indicate non-movement of the railway vehicle, may be identified again; note that this procedure can be done while driving. Further note that steps i'") through iv'") may also be done independently of steps i) through v).

Further advantages can be extracted from the description and the enclosed drawing. The features mentioned above and below can be used in accordance with the invention either individually or collectively in any combination. The embodiments mentioned are not to be understood as exhaustive enumeration but rather have exemplary character for the description of the invention.

BRIEF DESCRIPTION OF THE DRAWINGS

The invention is shown in the drawing.

DETAILED DESCRIPTION is FIG. 1 shows a first embodiment of an inventive detector 10 for cold movement of a railway vehicle, such as a traction unit.

Figure 1:
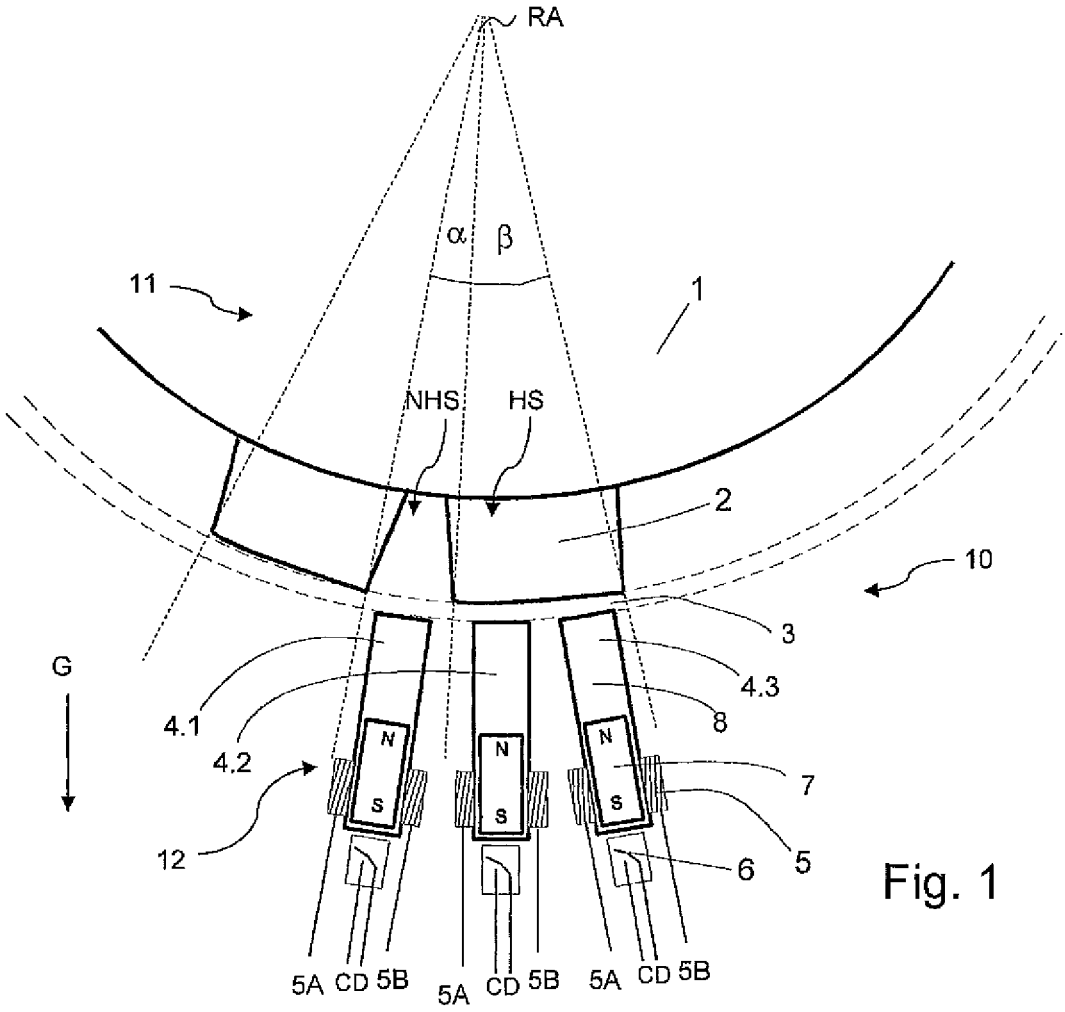
FIG. 1 shows a first embodiment of an inventive detector in a schematic cross-sectional view, with a toothed wheel type switching device and a circumferential arrangement of three detection cells.

The detector 10 comprises a switching device 11 and a group 12 of here three detection cells 4.1, 4.2, 4.3. The switching device 11 here comprises a toothed wheel 1, having congeneric and equidistantly arranged teeth 2 (only two of which are shown here for simplicity). At least the teeth 2 (and most simply the complete toothed wheel 1) are of a magnetisable (ferromagnetic) material, such as steel. The toothed wheel 1 is pivot mounted with respect to a rotation axis RA; preferably, the toothed wheel 1 is directly attached to a wheel axis of the railway vehicle, or attached to a gear rigidly coupled to the wheel axis of the railway vehicle. Thus, when a wheel of the railway vehicle rolls on a rail below, this rolling causes a movement of the switching device 11, i.e. a rotation of the toothed wheel 1.

The detection cells 4.1, 4.2, 4.3 are arranged below the toothed wheel 1, along the circumference of the toothed wheel 1, with a gap 3 so the detector may work contact-less. In the example shown, each detection cell 4.1, 4.2, 4.3 spans an angle $\alpha$, corresponding to the angle spanned by a space between two neighbouring teeth 2; two neighbouring detections cells 4.1, 4.2, 4.3 span an angle $\beta$, corresponding to the angle spanned by one tooth 2. Note that the division of the toothed wheel 1 determines the relative arrangement of the detections cells.

Each detection cell 4.1, 4.2, 4.3 comprises an indicator item 7, here a permanent magnet, which is moveable within a guide 8, which is here a non-magnetisable tube closed at both ends. Note that the guide 8 of detection cell 4.2 is in parallel with the vertical direction of gravity G, and the guides of detection cells 4.1 and 4.3 are inclined by about 10° against the vertical direction here. Further, each detection cell 4.1, 4.2, 4.3 comprises an actuator 5, here an electromagnetic coil 5, which may be charged with a direct current via contacts 5A, 5B. Thus a magnetic force (depending on the current polarity acting upwards or downwards) can be exerted onto the indicator items 7. Finally, there is sensor 6, here of Reed contact type, for each detection cell 4.1, 4.2, 4.3, which can be read out via contacts C, D, for determining the position (item position) of the indicator items 7.

The indicator items 7 may be in a bottom item position (shown in FIG. 1), in which gravity force dominates the forces at the indicator items 7 in all detection cells. Then the teeth 2 are too far from the indicator items 7, even in detection cells 4.2 and 4.3, so that gravity force cannot be overcome by magnetic force.

Alternatively, the indicator items 7 may be in a top item position (not shown), in which the indicator items 7 are at the upper end of their guide 8. However, in order to stick there by means of magnetic force and against the gravity force, the latter requires that the switching device 11 (i.e. the toothed wheel 1) is in a device position (i.e. rotational position) in which a tooth 2 (and not a space between two teeth 2) is close to (directly above) a corresponding detection cell. Then the ferromagnetic tooth 2 and the permanently magnetic indicator item 7 in the top item position are close enough to each other such that the magnetic force is larger than gravity force on the indicator item 7, and the indicator item sticks in the top item position. In FIG. 1, detection cells 4.2 and 4.3 are in such a close position to the tooth 2 shown on the right hand side. Due to their importance for allowing holding of the indicator items 7, the teeth sections of the toothed wheel 1 are named holding sections HS.

Detection cell 4.1 is not in such a close position to a tooth 2 in FIG. 1. If the indicator item 7 of detection cell 4.1 was lifted up (by means of its actuator 5), only the space between the teeth 2 would be near to the indicator item 7, so no significant magnetic force would result, and the indicator item 7 would fall back (down) into the bottom item position again. Due to their importance for avoiding holding of the indicator items 7, the space sections between the teeth 2 of the toothed wheel 1 are named non-holding sections NHS.

In the example shown, and taking into account the gap 3 between the switching device 1 and the detection cells 4.1, 4.2, 4.3, when more than half of the angle above a detection cell is spanned by a tooth 2, the magnetic force may overcome gravity force in the top item position of an indicator item 7. Therefore in practice, in each rotation position of the toothed wheel 1, two detection cells are close to a holding section HS allowing a sticking of an indicator item 7 in the top item position by magnetic force after actuator forces have been switched off, and one detection cell is close to a non-holding section NHS causing a falling back of an indicator item 7 from the top item position into the bottom item position once actuator forces have been deactivated. Note that any detection cell is either close to a holding section or close to a non-holding section at any time.

In the device position shown in FIG. 1, detection cells 4.2. and 4.3 are close to a holding section HS, and detection cell 4.1 is close to a non-holding section NHS. However, if the switching device 11 was, due to a movement of the railway vehicle, rotated e.g. counter-clockwise, then the allocation (or status) of the detection cell close to a non-holding section NHS would change from detection cell 4.1 to 4.2 and then to 4.3 (and then to 4.1 again and so on). These allocation (or status) changes, i.e. changes of the device position, are used for the inventive cold movement detection. When not distinguishing between different teeth 2, there are effectively three different device positions which are cyclically gone through in immediate sequence.

In the following, the detection procedure is described in more detail.

Initially, all indicator items 7 are in the bottom item position (see FIG. 1). All Reed contacts in sensors 6 are closed then.

With the railway vehicle in a standstill, all actuators 5 are activated so that all A of the permanently magnetic indicator items 7 are lifted up into the top item position by applying a suitable dc voltage at contacts 5A, 5B. After switching off the dc voltage, in the illustrated embodiment, a number N of here exactly two indicator items (in the device position shown of detection cells 4.2 and 4.3) stick to the top item position, whereas a number of A−N, i.e. here one, indicator item (here of detection cell 4.1) falls off. If desired, the sensors 6 may be read out now in order to determine how many and/or which detection cells have a stuck indicator item (in particular for checking purposes).

Now the system power of the detector 10 can be turned off, and after an arbitrary time interval, which is monitored by the detector 10, the system power can be turned on again.

By means of the sensors 6, it is now determined which indicator items 7 are in a top item position (indicated by an open Reed contact) and which indicator items 7 are in a bottom item position (indicated by a closed Reed contact). If the number B of indicator items 7 in the bottom item position is larger than A−N, i.e. here larger than one, then a movement during the turn-off time ("cold movement") can be assumed.

In case the number N of indicator items in the top item position after the deactivation of the actuators 5 and before turning off the system is not known (e.g. if said number depends on the initial device position of the switching device), a "cold movement" may be assumed upon any change in the item position of any one indicator item 7, as compared to the item positions immediately before turning off the system power (with the latter item positions preferably saved in a non-volatile memory).

During the turn-off time, a movement of the railway vehicle will, due to a mechanical coupling, lead to a change in the device position of the switching device 1. This in turn makes the non-holding section NHS move close to detection cells which were close holding sections HS before. As a result, indicator items 7 formerly stuck at the top will fall off, increasing the number B of indicator items 7 in the bottom item position. These additional indicator items 7 in the bottom item position are registered and used as movement indicators.

In accordance with the invention, the result of an inventive movement detection of a railway vehicle with an inventive detector may be noted to a central electronic system for coordinating traffic in a railway traffic network, in particular wherein the central electronic system is of ETCS level 2 type. If the noted result is a non-movement, then the central electronic system performs a simplified login procedure for the railway vehicle, and if the result is a movement, then the central electronic system denies a simplified login and requires a full login procedure for the railway vehicle.

In case of external magnetic fields, vibrations or a loss of magnetization and the like, stuck indicator items 7 will take the safe position of a "movement detected", since in these cases gravity (which cannot get lost) will make the indicator items 7 fall down. Thus external disturbances do not endanger the safety in the railway traffic network.

By designing the guides 8 as tubes, a jamming of the indicator items 7 is unlikely. However, the movability of the indicator items 7 may be checked by suitable use of the actuators 5 and the sensors 6. In the course of the checking procedures, the actuators 5 act to put the indicator items in a defined state (possibly including expected fall-off occurrences), and the sensors 6 check whether the expected defined state is actually assumed. If the expected defined state is not assumed, a defect is indicated.

Figures 2A, 2B:
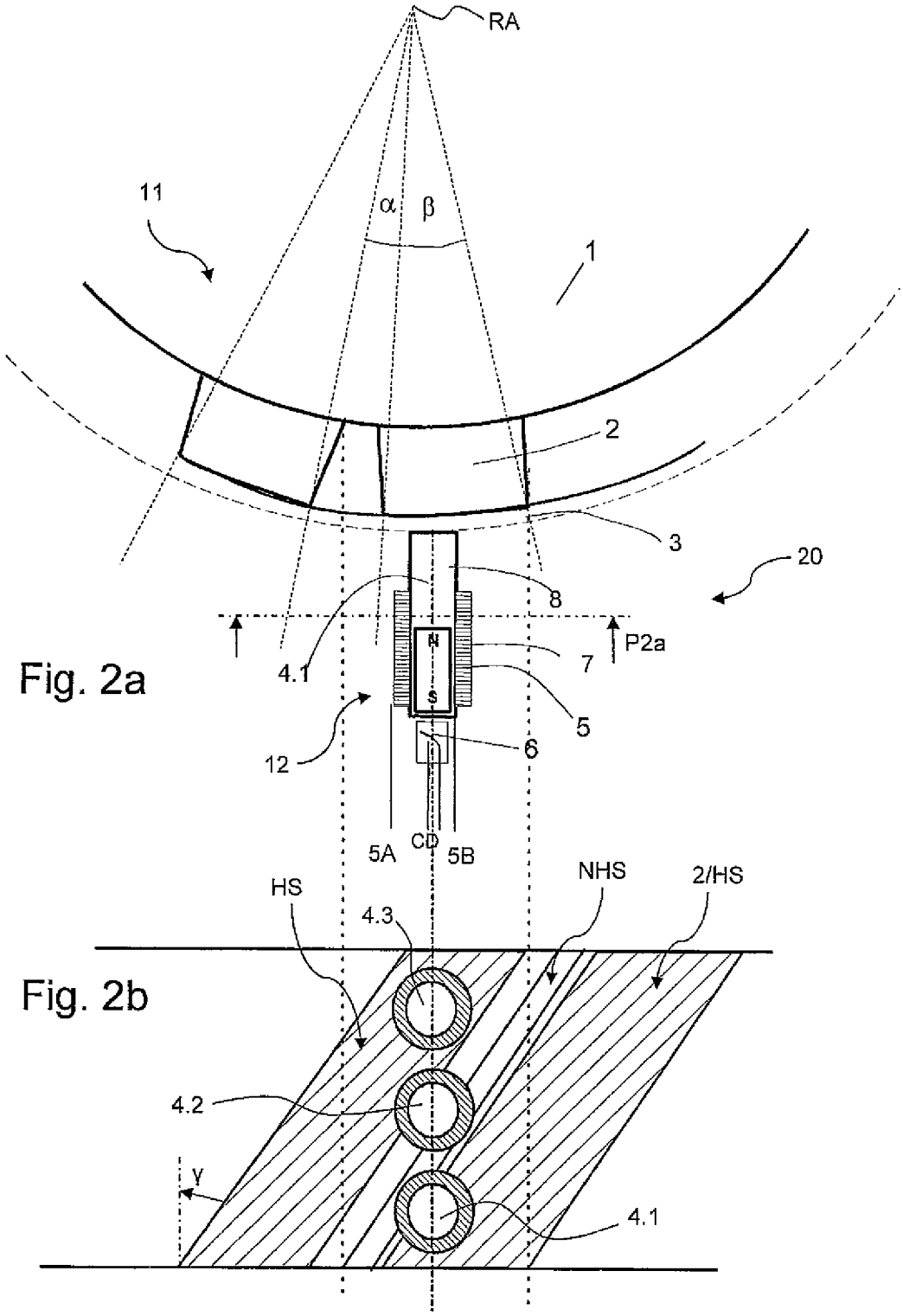
FIG. 2*a* shows a second embodiment of an inventive detector in a schematic cross-sectional view, with a toothed wheel type switching device and an axial arrangement of three detection cells.
FIG. 2*b* shows a cross-sectional view of the second embodiment, at plane P2*a* of FIG. 2*a;*

FIGS. 2*a* and 2*b* show a second embodiment of an inventive detector 20 similar to the embodiment shown in FIG. 1, so only the differences are discussed in detail. FIG. 2*b* is a cross-sectional view at plane P2*a* in FIG. 2*a*.

In the second embodiment, the detection cells 4.1, 4.2 and 4.3 of group 12 are arranged in parallel to the axis RA of the switching device 11, which is of toothed wheel type again. The teeth 2 are inclined by an angle γ with respect to the rotation axis RA of the toothed wheel 1. As a result, upon turning of the toothed wheel 1, the detection cells 4.1, 4.2, 4.3 are close to a non-holding sections NHS at different times. In the device position shown in FIG. 2*b*, detection cell 4.1 is just close to the right holding section HS, detection cell 4.2 is just close to the central non-holding section NHS, and detection cell 4.3 is close to the left holding section HS.

Figures 3A, 3B:
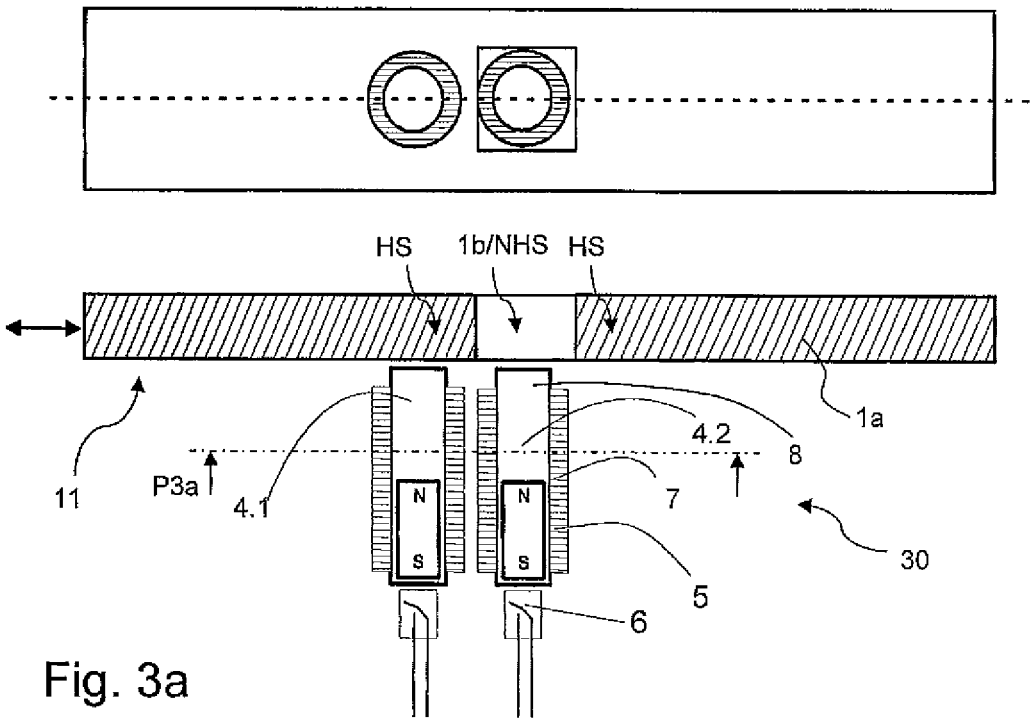
FIG. 3*a* shows a third embodiment of an inventive detector in a schematic cross-sectional view, with a slide type switching device and two detection cells.
FIG. 3*b* shows a cross-sectional view of the third embodiment, at plane P3*a* of FIG. 2*a*.

FIGS. 3*a* and 3*b* illustrate a third embodiment of an inventive detector 30 similar to the detectors shown before, so only the differences are discussed in detail. FIG. 3*b* shows a cross-section at plane P3*a*.

Here the switching device 11 is designed as a slide 1*a*, which may move horizontally in a cyclic back and forth fashion; in the figures, the most right position is shown, and the amplitude of the movement corresponds approximately to the distance between the two detection cells 4.1, 4.2. The slide 1*a* is linked to a railway vehicle's wheel axis by means of an eccentric for this purpose (not shown).

The slide 1*a* is of ferromagnetic material, and has an opening 1*b*, with a width again approximately corresponding to the distance between the detection cells. The opening acts as a non-holding section NHS, whereas the neighbouring side parts of the slide 1*b* act as holding sections HS.

In every movement position of the slide 1*a*, exactly one detection cell (in device position of FIG. 3*a* detection cell 4.2) is close to a non-holding section NHS, and exactly one detection cell (in the device position of FIG. 3*a* detection cell 4.1) is close to a holding section HS. During the movement cycle the allocation of HS and NHS to the detection cells chances, meaning that a next device position has been reached; note that here during a movement cycle the allocation changes twice, and there are effectively two device positions to switch between.

FIG. 3*a* also indicates that actuators 5 which are designed as electromagnetic coils may extend along the full length of the guide 8, in order to facilitate an interaction with the indicator item 7 in the top item position.

In summary, the present invention relates to a detector for detecting a movement of a railway vehicle in a powerless time interval. At the beginning of the time interval, indicator items or first magnetic antagonists of detection cells are lifted by actuators to a switching device, which provides at least one holding section or second magnetic antagonist for a part of the indicator items which then stick to or near to the switching device by magnetic force. The switching device, though, is movably mounted and coupled to the railway vehicle's movement, so the holding section moves relative the detection cells if the railway vehicle moves. As a result, detection cells from which the holding section moves away experience a drop of the indicator item due to gravity. By means of sensors, such a drop can be detected at the end of the time interval and used for cold movement indication.

What is claimed is:

1. A detector for cold movement detection of a railway vehicle, comprising:

a switching device comprising at least one holding section and at least one non-holding section, wherein the switching device is moveable between at least two device positions actuated by a mechanical coupling to the railway vehicle's movement; and at least two detection cells, each of the at least two detection cells comprising:

an indicator item;

a guide along which the indicator item is movable between a top item position and a bottom item position, wherein the guide is oriented basically parallel to gravity;

an actuator configured to move the indicator item between the top and bottom item position; and a sensor configured to determine the position of the indicator item in the bottom item position;

wherein the at least two detection cells are positioned below the switching device, wherein each indicator item is configured to overcome gravity and attract to the at least one holding section, and wherein each indicator item is configured to not overcome gravity and not attract to the at least one non-holding section.

2. The detector according to claim 1, wherein the at least one holding section is ferromagnetic, the at least one non-holding section is non-ferromagnetic, and the indicator item comprises a permanent magnet.

3. The detector according to claim 2, wherein the actuator comprises an electromagnetic coil.

4. The detector according to claim 1, wherein the at least two detection cells comprise at least three detection cells wherein in each device position of the at least two device positions at least two detection cells are close to a holding section.

5. The detector according to claim 1, wherein the at least two detection cells are positioned below the switching device and configured that upon moving through all device positions of the at least two device positions each detection cell is close to a non-holding section (NHS) at least once.

6. The detector according to claim 1, wherein the at least two detection cells are positioned below the switching device and configured that upon moving to a next device position of the at least two device positions, at least one detection cell changes from being close to a non-holding section to being close to a holding section.

7. The detector according to claim 1, wherein the switching device is configured where the movement of the switching device actuated by the railway vehicle's movement is cyclic.

8. The detector according to claim 1, wherein the sensor comprises a Reed switch.

9. The detector according to claim 1, wherein the switching device comprises a toothed wheel.

10. The detector according to claim 1, wherein the switching device comprises a slide.

11. A method for operating the detector according to claim 1, comprising:

bringing the railway vehicle to a stop;

moving all indicator items into the top item position by the actuators;

deactivating the actuators;

waiting for an arbitrary time interval;

determining the positions of the indicator items by the sensors; and counting a number of indicator items in the bottom item position; and determining whether a cold movement of the railway vehicle has occurred.

12. The method according to claim 11, including the step of determining whether a malfunction is indicated, comprising:

moving all indicator items into the bottom item position by the actuators;

determining the positions of the indicator items by the sensors;

counting the number of indicator items in a bottom item position; and comparing the number of indicator items in the bottom item position with the total number of indicator items.

13. The method according to claim 11, including the step of determining whether a malfunction is indicated, comprising:

moving all of the indicator items into the to item position by the actuators;

determining the positions of the indicator items by the sensors; and counting the number of indicator items in a bottom item position.

14. The method according to claim 11, including the step of determining whether a malfunction is indicated, comprising:

moving all of the indicator items into the top item position by the actuators;

deactivating the actuators;

driving some distance with the railway vehicle where all device positions of the at least two device positions have been gone through at least once;

determining the positions of the indicator items by the sensors;

counting the number of indicator items in a bottom item position; and comparing the number of indicator items in the bottom item position with the total number of indicator items.

15. A method for operating the detector according to claim 1, comprising:

bringing the railway vehicle to a stop;

moving all indicator items into the top item position by the actuators;

deactivating the actuators;

determining the positions of the indicator items by the sensors;

counting the number of indicator items in a top item position;

waiting for an arbitrary time interval;

determining the positions of the indicator items by the sensors;

counting the number of indicator items in a bottom item position; and determining whether a cold movement of the railway vehicle having taken place is indicated.

16. The detector of claim 1, wherein the at least two detection cells are positioned below the switching device and configured that upon the switching device moving between the at least two device positions, at least one detection cell changes from being close to the at least one holding section to being close to the at least one non-holding section.

17. The detector of claim 1, wherein the indicator item close to the holding section is configured to remain in the top item position through magnetic attraction and is configured to drop from the top item position to the bottom item position when the switching devices moves between the at least two device positions where now the at least one non-holding section is directly above the indicator item.

18. A detector for cold movement detection of a railway vehicle, comprising:

a switching device comprising at least one holding section and at least one non-holding section, wherein the switching device is moveable between at least two device positions actuated by a mechanical coupling to the railway vehicle's movement; and at least two detection cells, each of the at least two detection cells comprising:

an indicator item;

a guide along which the indicator item is movable between a top item position and a bottom item position, wherein the guide is oriented basically parallel to gravity;

an actuator configured to move the indicator item between the top and bottom item position; and a sensor configured to determine the position of the indicator item in either the top or bottom item position;

wherein the at least two detection cells are positioned below the switching device, wherein each indicator item is configured to overcome gravity and magnetically attract to the at least one holding section in the top item position when the at least one holding section is directly overhead, wherein each indicator item is configured to not overcome gravity and not magnetically attract to the at least one non-holding section in the top item position when the at least one non-holding section is directly overhead.

19. The detector of claim 18, wherein the indicator item close to the holding section is configured to remain in the top item position through the magnetic attraction and is configured to drop from the top item position to the bottom item position when the switching devices moves between the at least two device positions where now the at least one non-holding section is directly above the indicator item.

* * * * *

UNITED STATES PATENT AND TRADEMARK OFFICE

CERTIFICATE OF CORRECTION

PATENT NO. : 8,453,976 B2
APPLICATION NO. : 13/409461
DATED : June 4, 2013
INVENTOR(S) : Veit Lauterberg It is certified that error appears in the above-identified patent and that said Letters Patent is hereby corrected as shown below:

In the Claims

Claim 11, Column 10, line 47, delete “and”.

Claim 13, Column 10, line 64, “to” should be changed to --top--.

Claim 17, Column 12, line 2, “moves” should be changed to --move--.

Claim 19, Column 12, line 38, “moves” should be changed to --move--.

Signed and Sealed this
Thirteenth Day of August, 2013

Teresa Stanek Rea
*Acting Director of the United States Patent and Trademark Office*